United States Patent [19]

Stepantsov et al.

[11] 4,191,045

[45] Mar. 4, 1980

[54] POWER HAMMER WITH OPPOSED MOVEMENT OF RAM AND BOLSTER

[76] Inventors: Georgy K. Stepantsov, ulitsa Belinskogo, 21, kv. 36; Valentin S. Abramov, ulitsa Dekabristov, 191, kv. 91, both of Kazan; Jury N. Bloschitsyn, Yasenevo, mikroraion 1, korpus 1, kv. 141, Moscow; Raif R. Zaripov, ulitsa Gvardeiskaya, 24, kv. 74, Kazan, all of U.S.S.R.

[21] Appl. No.: 923,684

[22] Filed: Jul. 11, 1978

[51] Int. Cl.[2] ..... B21J 7/22

[52] U.S. Cl. ..... 72/407; 72/453.18

[58] Field of Search ..... 72/430, 407, 453.01, 72/453.02, 453.18; 29/421 E; 173/134

[56] References Cited

U.S. PATENT DOCUMENTS

| | | | |
|---|---|---|---|
| 2,655,002 | 10/1953 | Terhune | 72/407 |
| 3,429,174 | 2/1969 | Fracke | 72/407 |
| 3,552,181 | 1/1971 | Chan | 72/430 |
| 3,596,499 | 8/1971 | Sauerbrey | 72/407 |
| 3,780,560 | 12/1973 | Zimmer | 72/407 |
| 3,822,579 | 7/1974 | Kononenko | 72/407 |
| 3,847,008 | 11/1974 | Schmoll | 72/407 |

FOREIGN PATENT DOCUMENTS

| | | | |
|---|---|---|---|
| 1087548 | 10/1967 | United Kingdom . | |
| 1315448 | 5/1973 | United Kingdom . | |
| 1336484 | 2/1973 | United Kingdom . | |
| 1413364 | 2/1975 | United Kingdom . | |
| 267308 | 7/1922 | U.S.S.R. | 72/430 |
| 490547 | 1/1976 | U.S.S.R. | 72/430 |

OTHER PUBLICATIONS

*Innovations in Impact Forging Equipment*, by V. F. Scheglov, Moscow, 1968, pp. 198–201.

*Primary Examiner*—Francis S. Husar
*Assistant Examiner*—Gene P. Crosby
*Attorney, Agent, or Firm*—Fleit & Jacobson

[57] ABSTRACT

A power hammer with opposed movement of a ram and a bolster. The hammer has a stationary main frame accommodating, with provision for vertical displacements, a power frame. A bolster supporting a blank is attached to the power frame. Also, attached to the power frame is an actuating cylinder provided with a space above its piston serving as a gas chamber, a space below its piston filled with a fluid, and a piston rod carrying a ram with a top die. The hammer also incorporates a mechanism for accelerating the power frame by an additional force equal to, or exceeding by a specified amount, its weight. The mechanism includes spaces provided in the lower portion of the power frame and communicating with the space below the piston of the actuating cylinder, as well as vertical plungers extending inside each of the lower portion spaces and resting on the main frame. An arrangement like this one allows employing the hammer for forging components of various type and size by making use of blow energies varying over a substantially wide range.

4 Claims, 1 Drawing Figure

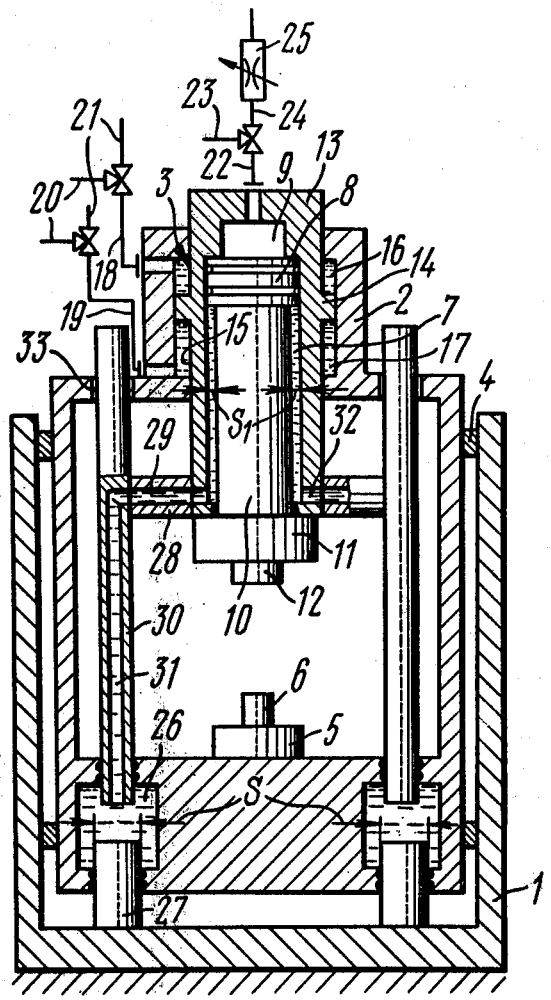
25
23
24
21
22
9
13
20
3
8
16
14
18
2
7
19
15
17
33
4
S1
32
29
28
11
12
10
30
31
6
26
5
S
1
27

POWER HAMMER WITH OPPOSED MOVEMENT OF RAM AND BOLSTER

FIELD OF THE INVENTION

The present invention relates to presswork equipment and has particular reference to power hammers with the head-on movement of ram and bolster. It may be used to advantage in the manufacture of components requiring blow energies of a magnitude varying over a wide range, as this is the case, for example, in forging turbine blades and compressor blades of various type and size.

BACKGROUND OF THE INVENTION

Widely known in the art are power hammers with the head-on movement of ram and bolster each whereof incorporates a power frame accommodated in guides of a stationary main frame with provision for vertical displacements and carrying a bolster (bottom die) giving support to a blank and also an actuating cylinder provided with a space below the piston filled with a gas under a pressure for returning the piston into, and retaining it in, the initial position as well as with a space above the piston serving as a gas chamber whereas attached to the piston rod is a ram with a top die. Each of such hammer is provided with a means of accelerating the power frame by a force which is equal to, or exceeds by a specified amount, its weight.

As far as the known hammers are concerned said means of accelerating consists of an air cylinder fitted to the main frame so that the piston rod abuts against the lower surface of the power frame. In the known hammers, the movement of the ram and bolster toward each other and, consequently, the movement of those structural members to which the ram and bolster are attached is induced by the action of a compressed gas admitted simultaneously into the gas chamber and the space under the piston of the air cylinder from an air line. To prevent shock loads from coming on the main frame of the hammer, the movement of the structural members towards each other must take place due to the effect of such momentum of these members (i.e., the product of their mass and velocity) which causes the power frame to come to a halt on striking the blank and then to settle gradually into its initial position as soon as the gas is bled from the air cylinder.

This requirement can be fulfilled if at the instant of the stroke the ratio of the momentum of the power frame integrally with the bottom die to that of the piston integrally with the piston rod, ram and top die is either unity while subject to forging is a blank displaying plastic deformation (the stroke recovery factor is zero in this case) or is greater than unity by a certain amount depending on the stroke recovery factor when forged is a blank displaying both plastic and elastic deformation (the stroke recovery factor is other than zero in this case).

To achieve in the known hammers an equilibrium between the momentums of the structural components striking against each other, the force exerted by the air cylinder is to be equal to the weight of the power frame, but to give the power frame a momentum exceeding the momentum of the piston integrally with the piston rod, ram and top die, the force developed by the air cylinder must exceed the weight of the power frame by a certain amount.

Since the force exerted by the air cylinder is the product of the cross-sectional area of the piston and the air pressure while for each particular hammer the weight of the power frame is a constant, it stands to reason that the specified ratio of the momentums of the members striking against each other is obtainable in the known hammers with a definite cross-sectional area of the piston by maintaining the gas pressure in the air line at a quite definite level. Should it occur that the gas pressure rises above this level, the consequence is that the power frame continues its upstroke after a blow has been delivered against the blank and thus gains potential energy which, on being transformed into kinetic energy, is transmitted to the main frame of the hammer in the form of a shock load. On the other hand, a gas pressure below the specified level causes a downward displacement of the power frame after the blow against the blank with the result that the main frame of the hammer will also be exposed to a shock load.

Taking into account that the shock loads the main frame and foundation of the hammer are subject to produce seismic effects detrimental to the surroundings, it is desirable to keep these loads as low as possible. This implies that in the known hammers the pressure of gas in the gas chamber and in the space below the piston of the air cylinder should not appreciably differ from the specified value. Inasmuch the blow energy the hammer possesses is controlled by the pressure of gas in the gas chamber, said energy can be changed in the known hammers only over a relatively narrow range which is a factor impairing processing capability of the hammer.

Another point is that in the known hammers the movement of the ram and bolster towards each other during each cycle is preceded by the bleeding of compressed gas from the space below the piston of the actuating cylinder and, moreover, the power frame returns into its original lowermost position while compressed gas in being bled from the space below the piston of the air cylinder. The consequence is high consumption of compressed gas and poor economy of the hammer.

SUMMARY OF THE INVENTION

The main object of the present invention is to increase the processing capability of the hammer with the head-on movement of ram and bolster.

Another object of the present invention is to improve the economy of the hammer.

In accordance with said and other objects, in a power hammer with the head-on movement of ram and bolster incorporating a power frame accommodated in guides of a stationary main frame with provisions for vertical displacements and carrying a bolster which gives support to a blank; an actuating cylinder provided with a space below the piston which is filled with a fluid under a pressure for returning the piston into—and retaining it in—the initial position as well as with a space above the piston which served as a gas chamber, a ram with a top die being attached to the piston rod of the cylinder; and a means of accelerating the power frame by a force equal to, or exceeding by a specified amount, its weight, the means of accelerating the power frame consists in accordance with the invention of spaces which are provided in the lower portion of the power frame, are filled with a fluid and communicate with the space below the piston of the actuating cylinder as well as of vertical plungers extending inside each of the spaces in the power frame and resting on the stationary main frame, the ratio of the aggregate cross-sectional area of the plungers to the cross-sectional area of the space below the piston of the actuating cylinder being half as much again to twice the ratio of the mass of all movable components of the hammer to the mass of the piston integrally with the piston rod, ram and top die.

By virtue of the principle disclosed, the force applied to the power frame and that acting on the piston of the actuating cylinder are constant and equal to the weight of the power frame integrally with the bolster and to half as much again to twice the weight of the piston integrally with the piston rod, ram and to die, respectively. As a result, the ratio of the momentums of the parts striking against each other is constant, being determined by the compressibility of the fluid rather than by the pressure of the compressed gas admitted into the gas chamber of the hammer. This creates the prospect of forging components of different type and size by making use of blow energies varying over a wide range, increasing thus the processing capability of the hammer.

Furthermore, since the space below the piston of the actuating cylinder is always filled with fluid and so are the spaces available in the lower portion of the power frame, the potential energy the power frame acquires in the course of the head-on movement is used to lift the piston integrally with the piston rod into the initial position after the blow. This plan is conducive to improving the economy of the hammer.

It is expedient that the fluid used is a mixture of a gas and a liquid, for the compressibility of such mixture can be changed so as to provide for such a ratio of the momentums of the parts striking against each other which enables the power frame to come to a halt in its topmost position on delivering the stroke against the blank, said ratio being determined by the stroke recovery factor of the blank concerned. This also improves the processing capability of the hammer.

DESCRIPTION OF THE PREFERRED EMBODIMENT

A detailed description of a power hammer with the head-on movement of ram and bolster materialized in accordance with the invention will follow and this description should be read in conjunction with the accompanying drawing which is a schematic sectional elevation of the power hammer with head-on movement of ram and bolster.

The power hammer with the head-on movement of ram and bolster incorporates a stationary main frame 1, a power frame 2, an actuating cylinder 3 and a means of accelerating the power frame 2 by a force equal to, or exceeding by a specified amount, its weight.

The power frame 2 is accommodated in guides 4 of the main frame 1 with provision for vertical displacements and carries a bolster 5 (bottom die) providing support to a blank 6. The actuating cylinder 3 is disposed inside the power frame 2 and is provided with a space 7 below the piston filled with a fluid under a pressure serving to return a piston 8 into, and retain it in, the original position as well as a space above the piston 8 functioning as a gas chamber 9. A ram 11 with a top die 12 is attached to a piston rod 10 of the actuating cylinder 3. The body 13 of the actuating cylinder 3 is given a cylindrical shape and is secured in the power frame 2 bottom upwards with provision for axial displacements while positioning the actuating cylinder. Available on the outside surface of the body 13 of the actuating cylinder 3 is a collar 14 fitting into an annular recess 15 provided in that surface of the power frame 2 which is contiguous to the outside surface of the body 13 of the actuating cylinder 3. The collar 14 subdivides the annular recess 15 into two spaces 16 and 17 filled with a fluid (for example, a liquid) serving the purpose of adjusting the position of the body 13 of the actuating cylinder 3.

Two unions 18 and 19 are provided in the upper portion of the power frame 2 level with the spaces 16 and 17, enabling said spaces 16 and 17 to be alternately connected to hydraulic lines 20 and 21 of low and high pressure, respectively. Another union 22 is provided in the bottom of the body 13 of the actuating cylinder 3 serving to connect the gas chamber 9 to a high-pressure air line 23 and, alternatively, to the atmosphere by way of an air line 24. The air line 24 is fitted with a throttle 25 for controlling the flow of compressed gas when the gas is being bled from the gas chamber into the atmosphere.

The means of accelerating the power frame 2 is provided in the form of spaces 26 in the lower portion of the power frame 2 which are filled with a fluid and communicate with the space 7 below the piston 8 of the actuating cylinder 3, the spaces 26 operating in conjunction with vertical plungers 27 which rest on the main frame 1 and extend inside said spaces 26 by an amount which changes due to the movement of the power frame 2 so that the volume of the spaces 26 consequently changes.

To place the spaces 26 into communication with the space 7 below the piston 8 of the actuating cylinder 3, attached to the lower part of the body 13 of the actuating cylinder 3 is a cross member 28 which has passages 29 and carries two uprights 30. Each of these uprights is also provided with a passage 31 connected to the passage 29 inside the cross member 28 and, furthermore, passages 32 opening into the space 7 below the piston 8 of the actuating cylinder 3 are provided in the body 13 level with the passages 29. The uprights 30 fit with their upper ends into holes 33 provided in the top portion of the power frame 2 and the lower ends of the uprights 30 extend inside the spaces 26 so that the passages 31 in the uprights are connected to the spaces 26.

The space 7 below the piston 8 of the actuating cylinder 3, the spaces 26, the passages 29, 31 and 32 are filled with a fluid which is, for example, a mixture of a gas and a liquid taken in amounts which assure the positioning of the power frame 2 at a given height above the main frame 1 when the hammer is in the initial position and provide for the requisite ratio of the momentums of the parts striking against each other when the hammer is in operation.

In the means of accelerating the power frame, the ratio of the aggregate cross-sectional area, S, of the plungers 27 to the cross-sectional areas, $S_1$, of the space 7 below the piston 8 of the actuating cylinder 3 is half as much again to twice the ratio of the mass of all movable parts of the hammer (the power frame 2 with the bolster 5, the body 13 of the actuating cylinder with its piston 8 and piston rod 10, the ram 11 and the top die 12, the uprights 30 and the cross member 28) to the mass of the piston 8 integrally with the piston rod 10, the ram 11 and the top die 12.

Operation

In the initial position, the gas chamber 9 is connected to the atmosphere via the union 22 and the air line 24. The pressure of the fluid present in the spaces 26 and the space 7 below the piston 8 of the actuating cylinder 3 sets the power frame 2 into a definite position above the main frame 1 and also sets the piston 8 with the piston rod 10, the ram 11 and the top die 12 into their topmost position, the pressure built-up in the fluid up to the specified level resulting due to the weight of the movable parts of the hammer without a recourse to any additional devices. The force acting on the piston 8 due to the pressure of the fluid is half as much again to twice the weight of the piston integrally with the piston rod 10, the ram 11 and the top die 12, sufficing to cause the piston 8 to return into its original position and to retain it therein.

The ratio of the components comprising the fluid can be either computed by a known method or determined experimentally with due regard to the elastic and plastic properties of the blank 6, its shape and size. Blanks behaving during forging so that the stroke recovery factor is zero call for a maximum percentage of the gas by volume whereas in forging blanks characterized by a stroke recovery factor other than zero it is practical to increase the percentage of the liquid.

Should the necessity arise to move the body 13 of the actuating cylinder 3 upwards for the purpose of increasing the stroke of the piston 8, said stroke being equal to the distance between the top die 12 and the bolster 5, the spaces 16 and 17 are connected to the high- and low-pressure lines 21 and 20, respectively, by means of the unions 18 and 19, respectively. To reduce the stroke of the piston 8, the spaces 16 and 17 are connected to the lines 20 and 21, respectively. Any displacement of the body 13 of the actuating cylinder 3 either up or down brings about a rising of the uprights 30 out of the spaces 26 so that their volume increases or a sinking of the uprights into the spaces, respectively, with the result that the volume of said spaces decreases. In response to these displacements the power frame 2 either rises or lowers, respectively, with respect to the main frame 1.

The blank 6 is placed on the bolster 5, and the gas chamber 9 is connected to the high-pressure air line 23 by means of the union 22. The pressure of the compressed gas admitted into the gas chamber 9 from the air line 23 causes the piston 8 of the actuating cylinder 3 to move downwards integrally with the piston rod 10, the ram 11 and the top die 12 while the power frame 2 moves upwards integrally with the body 13 of the actuating cylinder 3. When the piston 8 is on the move, the fluid is expelled from the space 7 below the piston through the passages 32 and reaches the spaces 26 by way of the passages 29 and 31, thus adding to the amount of fluid available in these spaces when the power frame is in motion.

If the ratio of the aggregate cross-sectional area of the plungers 27 to the cross-sectional area of the space 7 below the piston of the actuating cylinder is, in accordance with the invention, half as much again to twice the ratio of the mass of all movable parts of the hammer to the mass of the piston 8 integrally with the piston rod 10, the ram 11 and the top die 12, the volume of fluid expelled by the piston 8 from the space 7 below this piston is half as much again to twice the increase in the volume of the spaces 26 brought about by the displacement of the power frame 2 under the conditions of equilibrium of the momentums of these components.

This implies that if use is made of a fluid with a low compressibility (the percentage of the gas in the mixture is low), the movement of the piston 8 and the power frame 2 towards each other causes a pressure build up in the fluid, bringing about an increase in the force hampering the acceleration of the piston 8 with a simultaneous increase in the force facilitating the acceleration of the power frame 2. The ratio of the momentum to the power frame integrally with the body 13 of the actuating cylinder 3 and the bolster 5 to the momentum of the piston 8 integrally with the piston rod 10, the ram 11 and the top die 12 will be greater than unity in this case and the power frame will come to a halt in its topmost position, following the blow against the blank 6 displaying both plastic and elastic deformation (the stroke recovery factor is other than zero).

If, however, the fluid used has a high compressibility (the percentage of the gas in the mixture is high), the pressure of fluid will practically remain unchanged when the volume of fluid decreases in the course of the movement of the piston 8 and the power frame 2 towards each other so that the ratio of the momentums of the components striking against each other will be close to unity. The power frame will also come to a halt following the blow against the blank displaying plastic deformation.

As the blank 6 gets deformed due to the head-on stroke delivered against it by the ram 11 and the bolster 5, the gas chamber 9 is connected to the atmosphere through the union 22 and the air line 24 with the throttle 25. Compressed gas escapes from the gas chamber 9, enabling the piston 8 to lift into its topmost position due to the pressure exerted by the fluid on the annular surface of the piston 8. The rising of the piston 8 is accompanied by an increase in the volume of the space 7 below the piston. The pressure of the fluid entering this space decreases and consequently causes no obstruction to the lowering of the power frame 2 into its lowermost initial position in which the pressure of fluid acting on the power frame 2 is equal to its weight. The forged blank 6 is removed from the bolster 5. This completes the working cycle of the hammer, and the next cycle is repeated in the way described above.

What is claimed is:

1. A power hammer with opposed movement of ram and bolster comprising: a stationary main frame provided with guides; a power frame accommodated in the guides of said main frame with provision for vertical displacements; a bolster secured to said power frame and providing support for a blank; an actuating cylinder mounted on said power frame and having a piston positioned for movement therein; a space below the piston being filled with a fluid under a pressure for returning the piston into, and retaining it in, an initial position as well as with a space above the piston serving as a gas chamber; a ram carrying a top die and attached to a rod of the piston of said actuating cylinder; a means for accelerating said power frame by an additional force which is at least equal to the weight of the frame, serves to displace the power frame vertically and comprises spaces provided in lower portions of said power frame which are filled with a fluid and communicate with the space below the piston of said actuating cylinder; vertical plungers which rest on said main frame and extend inside said lower portion spaces of said means for accelerating the power frame, the ratio of the aggregate cross-sectional area of said plungers to the cross-sectional area of the space below the piston of said actuating cylinder being half as much again to twice the ratio of the mass of movable components of the hammer to the mass of the piston integrally with the piston rod, ram and top die.

2. A power hammer according to claim 1, wherein said additional force is greater than the weight of the frame.

3. A power hammer as claimed in claim 1 wherein the spaces for said means of accelerating said power frame and the space below the piston of said actuating cylinder are filled with a fluid which is a mixture of a gas and a liquid.

4. A power hammer according to claim 2, wherein said additional force is greater than the weight of the frame.

* * * * *